US006126167A

United States Patent [19]

Kowalczyk

[11] Patent Number: 6,126,167

[45] Date of Patent: Oct. 3, 2000

[54] CASINO TABLE CARD GAME

[76] Inventor: Patrick Michael Kowalczyk, 2608 Clifton Ave., St. Louis, Mo. 63139-2807

[21] Appl. No.: 09/080,572

[22] Filed: May 18, 1998

[51] Int. Cl.[7] ..... A63F 1/00

[52] U.S. Cl. ..... 273/303; 273/292; 273/274

[58] Field of Search ..... 273/292, 303, 273/274, 304, 305

[56] References Cited

U.S. PATENT DOCUMENTS

| | | | |
|---|---|---|---|
| 1,315,907 | 9/1919 | Burlew | 273/303 |
| 4,362,303 | 12/1982 | Pell | 273/274 |
| 5,265,881 | 11/1993 | Doherty | 273/274 |
| 5,282,633 | 2/1994 | Boylan et al. | 273/306 |
| 5,431,407 | 7/1995 | Hofberg et al. | 273/292 |

FOREIGN PATENT DOCUMENTS

| | | | |
|---|---|---|---|
| 1401881 | 4/1965 | France | 273/303 |

*Primary Examiner*—Benjamin H. Layno

*Attorney, Agent, or Firm*—Polster, Lieder, Woodruff & Lucchesi, L.C.

[57] ABSTRACT

A casino card game is disclosed employing a specially designed deck of cards comprising sets of cards related to a rainbow color theme. Cards within the deck are individually colored red, orange, yellow, green, blue, purple, gold or black. In the play of the game, several decks are combined and shuffled, and a first card is drawn from the deck. Additional cards are drawn one at a time from the deck, and compared with the previous cards drawn. If the color of a drawn card matches the color of a previously drawn card, a pair is indicated, and the round ends. The game is played on a game table arranged such that a dealer may be positioned at one end, and with a number of players seated or standing opposite the dealer. The table contains wager positions for placement of wagers by the players, with each position corresponding to a possible outcome during a round of the game. Wagers are placed on the table corresponding to a player's selection as to the possible outcome of the round. Outcomes each round may involve the color of the cards which produce the winning pair, the colors which are not revealed before the pair is made, the number of cards revealed to make the pair, and various combinations of cards revealed during play.

23 Claims, 2 Drawing Sheets

CASINO TABLE CARD GAME

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

This invention relates to a casino table card game, and more particularly, this invention is concerned with a rainbow theme-based card game with easy to understand rules that is played against a casino, and which includes the opportunity for multiple wagering by players on a variety of possible outcomes at each play of the cards.

The gaming industry, and in particular casino type gambling, has become a rapidly expanding business, resulting in the need for attracting new players to sustain revenue streams. New players may be initially drawn to a casino by means of promotional events or other one-time attractions, however, to develop repeat players, the casino must offer games which are interesting, exciting, and most importantly, easy to learn and play.

The games that are traditionally played in casinos vary widely in the complexity of the rules required to play the games and the skill involved in the play. In general, the more interesting and exciting the game, the more skill and personal involvement of the player is required. This tends to discourage novice players from playing some of the more interesting casino games.

One game of chance which is of some interest to new players is roulette. In roulette, a large number of betting positions, including multiple wagering positions, are selected by the players prior to the spin of a wheel. The outcome of each play of the game is based upon the position in the wheel upon which a rolling ball stops. Each position contains a color and number, and any bets placed upon the table corresponding to either the color or number are considered winning hands. The game provides new players with an exciting and interesting theme by allowing them to watch the action of the ball and spinning wheel. Players can try and anticipate the outcome of each play. However, despite having simple rules, roulette includes a large number of wagering positions, and is strictly a game of chance, with each spin of the wheel ending each play.

What would be highly desirable would be a casino card game having the positive attributes of roulette, including an interesting and exciting theme; simple play; numerous possible winning plays, that is playable equally well with a different number of players; and is played against the casino or house. It would also be desirable if the game included fewer bet positions with larger payoffs, a chance for players to win in a progressive jackpot, and allowed for play action to continue through multiple turns.

BRIEF SUMMARY OF THE INVENTION

Among the several objects and advantages of the present invention are:

The provision of a casino card game which incorporates an interactive theme with universal appeal;

The provision of the aforementioned casino card game which is played with visually stimulating colored cards;

The provision of the aforementioned casino card game which is based upon the primary colors of a rainbow;

The provision of the aforementioned casino card game in which players wager against the casino on the order in which colored cards are revealed;

The provision of the aforementioned casino card game which includes a progressive jackpot;

The provision of the aforementioned casino card game which is played on a table;

The provision of the aforementioned casino card game which may be adapted to electronic play;

The provision of the aforementioned casino card game in which the rules of play are easily learned and understood by players; and The provision of the aforementioned casino card game in which play is exciting and rapid.

Briefly stated, the casino card game of the present invention employs a specially designed deck of cards having a series of cards related to a rainbow color theme. Cards within the deck are individually colored red, orange, yellow, green, blue, purple, gold or black. In the play of the game, several decks are combined and shuffled, and a first card is drawn from the deck. Additional cards are drawn one at a time from the deck, and compared with the previous cards drawn. If the color of a drawn card matches the color of a previously drawn card, a pair is indicated, and the round ends.

The game is played on a game table arranged such that a dealer may be positioned at one end, and with a number of players seated or standing opposite the dealer. The table contains bet positions for placement of wagers by the players, with each position corresponding to a possible outcome during a round of the game. The players may place wagers on as many positions as they choose, but may not "straddle" bets by wagering more than one position with a single bet. Wagers are placed on the table corresponding to a player's selection as to the possible outcome of the round. Outcomes each round may involve the color of the cards which produce the winning pair, the colors which are not revealed before the pair is made, or the number of cards revealed up to, and including the pair card. Numerous other wager combinations are possible, and are described in detail below.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description will clearly enable one skilled in the art to make and use the invention, describes several embodiments, adaptations, variations, alternatives, and uses of the invention, including what we presently believe is the best mode of carrying out the invention.

Figure 1:
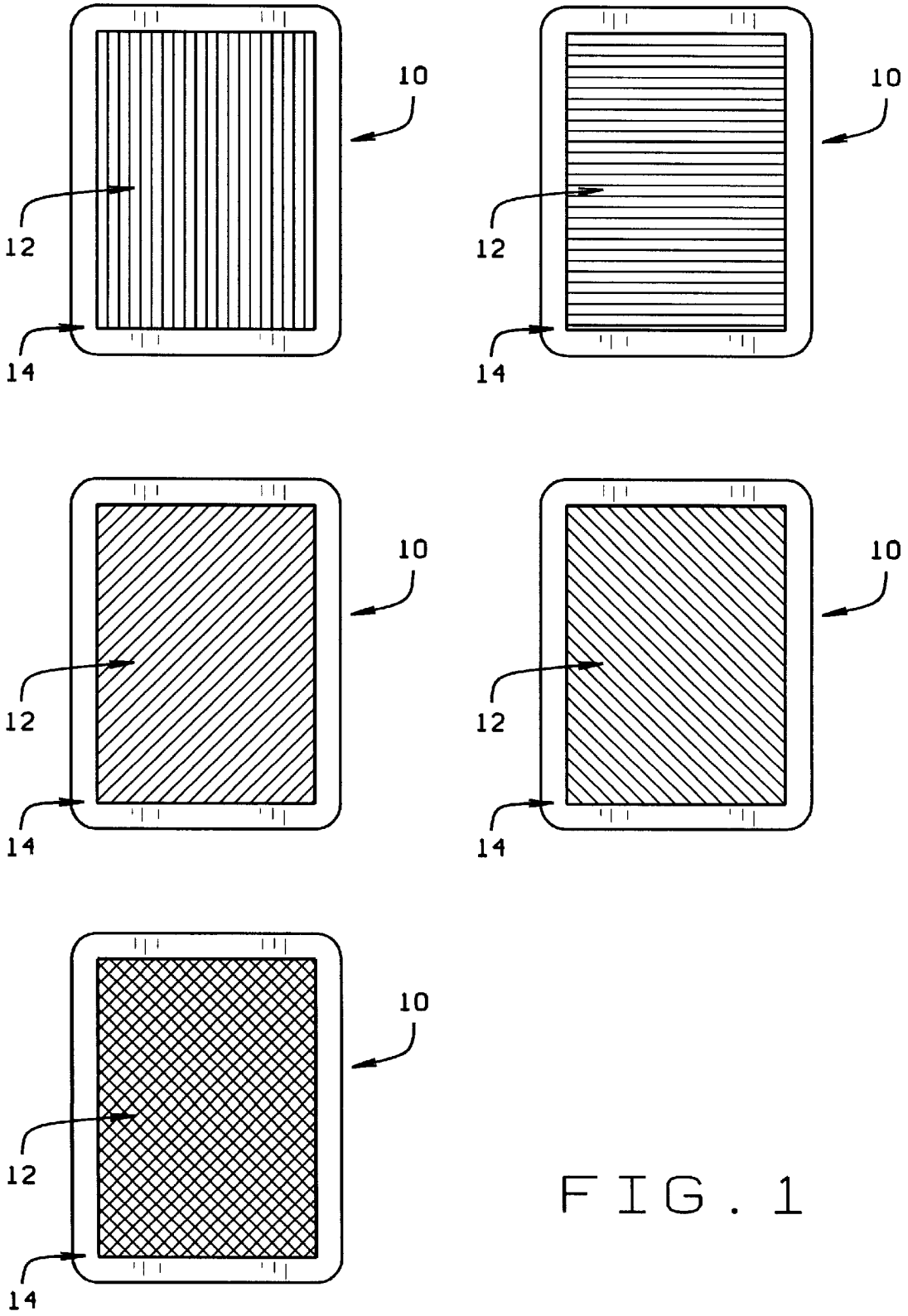
FIG. 1 is a illustration of a typical playing card for use with the present invention.

The card game of this invention is played with a deck of specifically designed cards, which includes a plurality of sets of colored cards. In the preferred embodiment, the deck contains forty-nine cards, divided into eight separate sets. Six sets each contain seven cards, and are identified by the color of the cards: red, orange, yellow, green, blue, and purple. The remaining two sets comprise four gold cards and three black cards, respectively. As is shown in FIG. 1, each colored card 10 includes a colored central region 12 and a white border 14, thereby preventing players from observing upcoming colors while the cards are in the deck. It will be recognized by one skilled in the art that alternate colors or indicia may be employed to demark the cards comprising the deck within the scope of the invention. In an alternate embodiment of the game seven additional cards are employed, providing more bet positions. The set of cards corresponding to the color purple is replaced by two new sets, each containing seven cards demarked by the colors indigo and violet, corresponding to the full sequence of colors in a rainbow. During the play of the game, a plurality of decks, preferably six, are combined and shuffled to provide a shoe from which cards are drawn by a dealer.

Figure 2:
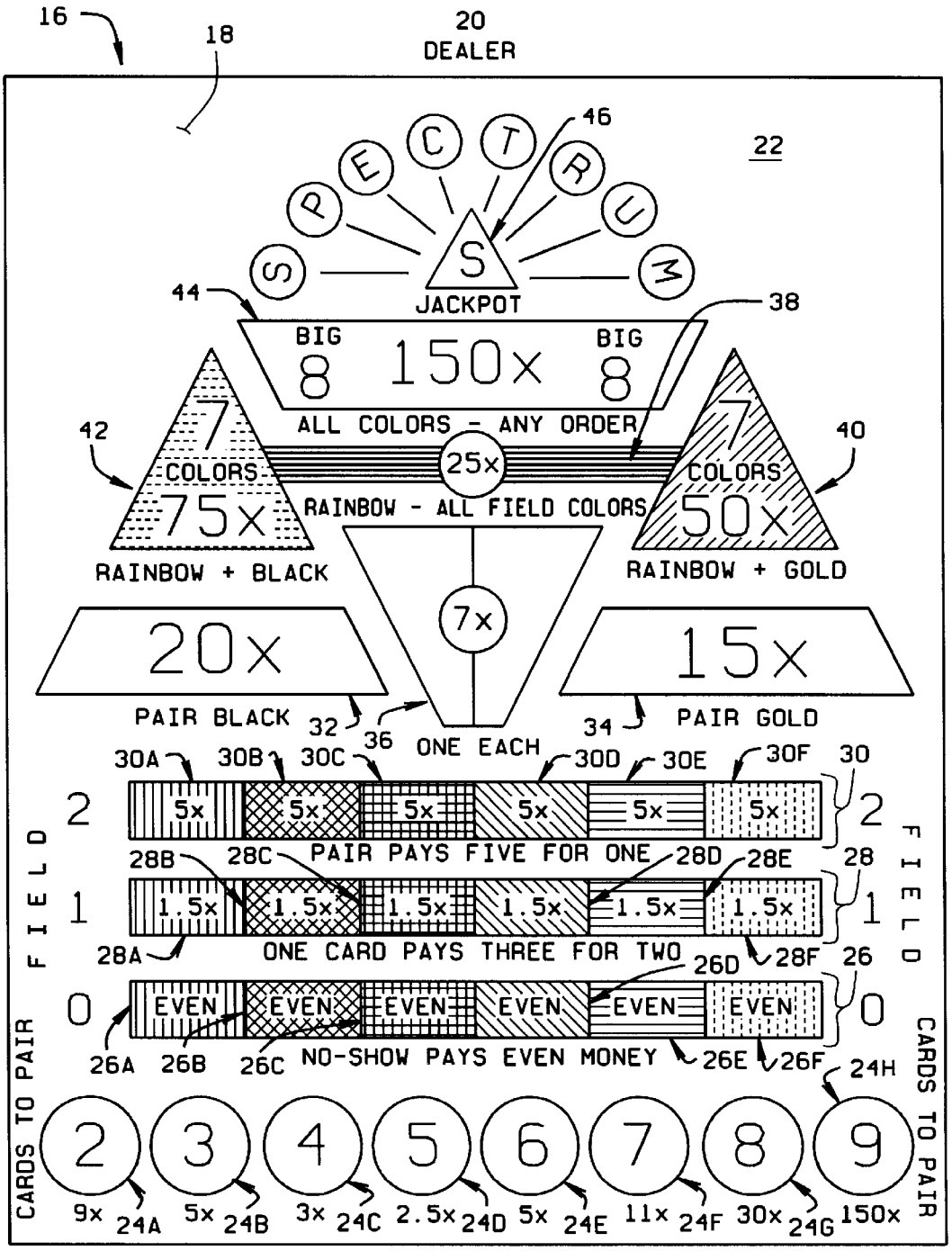
FIG. 2 is a top plan illustration of a game table layout for use in the play of the casino card game of this invention.

The play of the game will be illustrated with specific reference to the game layout 16 shown in FIG. 2. It should be appreciated however, that the game can be played with a different layout or without the use of a game layout and still be within the scope of the invention.

The game layout 16, as shown in FIG. 2, is essentially pyramidal, and is adapted to be displayed on a conventional casino gaming table 18. The dealer position 20 is at the center of the back edge of the game layout area 16. A bank area 22 is provided near the dealer for placement of a chip tray (not shown) to be used by the dealer to hold chips for paying off winning wagers and to place the chips collected on losing wagers. Players may position themselves around the remaining edges of the table, with the maximum number of players determined by the number of players the dealer can effectively handle.

The arrangement of wager positions on the table is designed to keep all wager positions within reach of any player at the table. Furthermore, most of the higher-odds wagers are situated close to the dealer. The wagers range from even money wagers to a progressive jackpot, and are approximately ordered from low to high. The following description of the wager positions and game layout 16 refers to the preferred embodiment of the invention. At the base of the table 18, opposite the dealer position are eight circles 24A–24H, numbered consecutively from two through nine. These positions are for wagers corresponding to the number of cards which will be drawn from the deck to reveal a pair. Once a pair of cards is revealed, either by matching any of the rainbow colors or by matching a pair of black or gold cards, the play is ended. Wagers placed in the numbers circles 24A–24H are paid as follows:

| Number of Cards to Pair | Pays |
|---|---|
| 2 | 9 times amount wagered |
| 3 | 5 times amount wagered |

-continued

| Number of Cards to Pair | Pays |
|---|---|
| 4 | 3 times amount wagered |
| 5 | 2.5 times amount wagered |
| 6 | 5 times amount wagered |
| 7 | 11 times amount wagered |
| 8 | 30 times amount wagered |
| 9 | 150 times amount wagered |

With eight different colors, as in the preferred embodiment, it will take no less than two draws from the deck, nor more than nine draws to produce a matching pair of cards.

Located above the pair-circles are three multi-colored or spectral bars 26, 28, 30, with each bar containing portions corresponding to the six colors of the rainbow represented by the cards of the deck. The lowermost bar 26 represents the no-show bar. Wagers are placed on the colored portions 26A–26F of the bar corresponding to the card color which is believed will not be dealt prior to the pair being revealed. As indicated within each portion of the bar 26, winning wagers on the no-show bar are paid even money. The middle bar is the one-card bar 28. Wagers are placed on the colored portions 28A–28F of the one-card bar corresponding to the card color which is believed will be shown only once prior to the pair being revealed. As indicated in each portion of the bar 28, winning wagers are paid three for two. The uppermost bar is the pair-bar 30. Players place wagers on the colored portions 30A–30F of the pair-bar which they believe represents the color of the cards which will be revealed in the pair. As indicated in the colored portions of the bar 30, winning wagers on the pair-bar are paid five for one.

Located above the spectral bars are two areas for placing wagers on the occurrence of a black or gold pair of cards. The black-to-pair region 32 is located on the left-hand side of the table 18 and twenty times the amount wagered. Correspondingly, the gold-to-pair region 34 is located on the right-hand side of the table, and pays fifteen times the amount wagered. Additionally, if the winning pair is gold, all non-winning wagers on the table, with the exception of the even-money no-show wagers, "push" to the next round, allowing players to retain the amounts bet, and remove or reposition their non-winning wagers. Centrally disposed between the black-to-pair and gold-to-pair regions is a one-each area 36 for wagering on the appearance of both one black and one gold card prior to the pair being drawn. A winning hand in this position pays seven times the amount wagered.

Located directly above the one-each area 36 is the rainbow area 38. Players placing wagers in this position will be paid twenty-five times any amount bet if all six rainbow colors (red, orange, yellow, green, blue and purple) are revealed in any order before a pair is made.

To the right and left of the rainbow area are seven-color areas 40, 42 corresponding to the combination of either the rainbow set and a gold card, or the rainbow set and a black card being revealed prior to a pair being made. The combination of the rainbow set of cards and the gold card pays fifty to one, while the combination of rainbow cards and a black card pays seventy five to one. In either case, the cards do not need to be revealed in any particular order to vin in these positions. Finally, wagers may be placed in the "big-eight" area 44 located above the rainbow area 38, on the occurrence of all eight colors, the rainbow set, a black card, and a gold card being exposed in any order before a pair is made. Wagers placed in this position are paid at one hundred fifty to one, the same as for a nine-card wager.

At the peak of the playing area, directly infront of the dealer position is the progressive spectrum jackpot area 46 denoted by a triangular outline. Wagers placed in the progressive jackpot area 46 are provided an opportunity to win all or a portion of the progressive jackpot. In order to win the progressive jackpot, players must place a wager before a winning hand is dealt by the dealer. Winning hands for the progressive jackpot comprise all eight colored cards of the preferred embodiment, dealt from the shoe without a pair match in one of the following orders:

Black, Red, Orange, Yellow, Green, Blue, Purple, Gold—Pays 100% of Jackpot

Gold, Red, Orange, Yellow, Green, Blue, Purple, Black—Pays 50% of Jackpot

Black, Gold, Red, Orange, Yellow, Green, Blue, Purple—Pays 25% of Jackpot

Gold, Black, Red, Orange, Yellow, Green, Blue, Purple—Pays 25% of Jackpot

Red, Orange, Yellow, Green, Blue, Purple, Black, Gold—Pays 25% of Jackpot

Red, Orange, Yellow, Green, Blue, Purple, Gold, Black—Pays 25% of Jackpot

An additional winning hand may consist of only the colors contained in the rainbow, arranged in the following order:

Red, Orange, Yellow, Green, Blue, Purple—Pays 10% of Jackpot

The rainbow portion of the winning hand must always be dealt in a continuous and uninterrupted order corresponding to the colors of the spectrum for the progressive jackpot to be won. Any other combination of the cards is not considered to be a winning progressive jackpot. Where multiple players have wagered on the progressive jackpot, the winnings are split equally among them upon a winning hand being dealt. In the preferred embodiment, players are only permitted to place $0.25 wagers on the progressive spectrum jackpot, with the jackpot funded entirely by the losing progressive jackpot wagers and a house contribution of $1.00 per hand dealt. The minimum amount to be paid to a single winner of the progressive jackpot is preferably $25,000. Those skilled in the art will recognize that additional methods and combinations of player and house contribution to the progressive jackpot will ensure a large enough jackpot to encourage player participation. The potential for large progressive jackpots is significant, especially if the progressive spectrum jackpot wagers are pooled from all spectrum game tables in a casino, or if other game tables and casinos are linked electronically to form a spectrum game network.

In the play of the game, a shoe consisting of several decks of cards is shuffled by the dealer. A player, selected at random, then cuts the cards using a white card, which is then placed at the end of the shoe for the next reshuffle. The first card is removed from the shoe and placed in a discard pile, and the game play is ready to begin.

The individual players place their initial wagers on the various areas of the game layout corresponding to the outcomes which the players feel are likely to occur. The dealer then draws the first game card from the shoe, placing it face up to reveal the card color. A second card is then drawn by the dealer, and placed face up adjacent the first card. If the colors of the cards match, forming a pair, the indicated color is declared the winning color and the game play is halted. If no pair is formed, the dealer continues to draw cards one by one from the deck until a match is made with any of the previously revealed cards. With the eight colors of the preferred embodiment, between two and nine cards may be drawn to produce a match. Once a pair is formed, the dealer, or an assistant, then pays the players with winning wagers, including the progressive spectrum jackpot, and removes the losing wagers and tokens from the game layout, placing them in the bank area. Note, as described above, if the color of the matched pair is gold, all wagers on the table, except the even-money no-show wagers, "push" to the next round, and there are no losing wagers to be removed from the table. After the winning wagers are paid, and the losing wagers removed from the table, the players place new wagers on the table, and the game play resumes.

The cards which were revealed during play are placed in the discard pile, with the last card drawn being placed in a separate location to prevent pairs from clustering within the deck. The cards in the discard pile are later shuffled separately and combined with the remainder of the shoe.

The actual playing odds of the spectrum card game, including the potential for winning the progressive spectrum jackpot, the odds of a particular colored card being revealed and the specific position in the game sequence where a match will be formed, are readily calculated using well-known statistical techniques. In alternate embodiments of the game, where additional card colors such as indigo and violet replace the purple cards, the playing odds and payoff amounts will vary accordingly. With nine total colors, the maximum hands needed to form a pair increases to ten, and the game layout is adjusted accordingly. Additional variations in the number of cards of each color may further alter the playing odds of the game, and may be used to provide a desired casino advantage.

The play of the casino card game of this invention is interesting and challenging for both experienced and novice players. The rules of play are straight fonvard and are readily and easily grasped by players having no prior gaming experience. The actual play of the game holds the interest of the players through the use of the strong central rainbow color theme and symbolism. The colors in the card correspond to the primary colors of the rainbow, denoting the symbolism of players finding their pot of gold at the end of the rainbow, and of a bridge between the gold and black cards, which are in turn symbolic of good/bad, heaven/earth, light/darkness, sun/rain etc. Due to the nature of the game play, rounds are played quickly, and players have the potential to achieve large payoffs on some wagers, resulting in an active and exciting game.

The casino card game of this invention can also readily be programmed to play on a video terminal, if desired, without any change or modification of the rules of play. This is a considerable advantage, in that the game can be played by players who would rather play by themselves against a machine, and also by persons who want to initially try the game in private rather than at a table with other players.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense.

What is claimed is:

1. A method of playing a card game with a house and at least one player using a deck of cards comprised of a plurality of sets of cards, with each set of cards being comprised of a plurality of identically marked cards, said method comprising the steps of:

(a) shuffling the deck to randomize the placement of said cards within said deck;

(b) opening a first card from the top of said deck, said card opened to reveal the marking on said card;

(c) opening a second card from the top of said deck to reveal the marking on said second card and compare said marking on said second card with the marking on said first card;

(d) if the marking on said second card is identical to the marking on said first card, a match is indicated and the game play is ended;

(e) if the marking on said second card is not identical to the marking on said first card, continuing opening and comparing additional cards from the top of said deck until a match with a previously opened card is made and the game play ended.

2. The method of playing a card game according to claim 1, wherein there are at least eight sets of cards in said deck.

3. The method of playing a card game according to claim 2 wherein there are at least three cards in each set.

4. The method of playing a card game according to claim 2 wherein the player wagers at the start of play and before each game card is opened as to the number of cards which will be opened to indicate a match.

5. The method of playing a card game according to claim 2 wherein the player wagers at the start of play and before each game card is opened as to the markings on said cards which will not be revealed prior to a match being indicated.

6. The method of playing a card game according to claim 2 wherein the player wagers at the start of play and before each game card is opened as to the marking on said cards which will only be revealed once prior to a match being indicated.

7. The method of playing a card game according to claim 2 wherein the player wagers at the start of play and before each game card is opened as to the markings on said cards which will be revealed in the match indicated.

8. The method of playing a card game according to claim 2 wherein the player wagers at the start of play before each game card is opened as to combinations of markings on said cards revealed prior to a match being indicated.

9. The method of playing a card game according to claim 2 wherein the player wagers at the start of play before each game card is opened in a progressive jackpot as to an ordered combination of markings on said cards revealed prior to a match being indicated.

10. The method of playing a card game according to claim 2 wherein the game is played on a video display terminal.

11. A game layout for the play of the card game according to claim 2 having indicia for placement of a wager.

12. The game layout according to claim 11 wherein said indicia for placement of wagers includes indicia for placement of wagers corresponding to the number of cards which may be opened to indicate a match.

13. The game layout according to claim 11 wherein said indicia for placement of wagers includes indicia for placement of wagers corresponding to markings on said cards which will not be revealed before a match is indicated.

14. The game layout according to claim 11 wherein said indicia for placement of wagers includes indicia for placement of wagers corresponding to markings on said cards which will be revealed only once before a match is indicated.

15. The game layout according to claim 11 wherein said indicia for placement of wagers includes indicia for placement of wagers corresponding to which markings will be opened to indicate a match.

16. The game layout according to claim 11 wherein said indicia for placement of wagers includes indicia for placement of wagers corresponding to a combination of markings which will be revealed before a match is indicated.

17. The game layout according to claim 11 wherein said indicia for placement of wagers includes indicia for placement of wagers in a progressive jackpot.

18. The game layout according to claim 11 wherein the indicia for placement of wagers includes a statement of odds paid on wagers.

19. The method of playing a card game according to claim 1 wherein said identical marking on each card comprising a set of cards corresponds to a color.

20. The method of playing a card game according to claim 19 wherein at least some of said sets of cards correspond to the colors red, orange, yellow, green, and blue.

21. The method of playing a card game according to claim 20 wherein at least some of said sets of cards correspond to the color purple.

22. The method of playing a card game according to claim 20 wherein at least some of said sets of cards correspond to the colors violet and indigo.

23. The method of playing a card game according to claim 20 wherein at least some of said sets of cards correspond to the colors black and gold.

* * * * *

UNITED STATES PATENT AND TRADEMARK OFFICE

CERTIFICATE OF CORRECTION

PATENT NO. : 6,126,167
DATED : October 3, 2000
INVENTOR(S) : Patrick Michael Kowalczyk It is certified that error appears in the above-identified patent and that said Letters Patent is hereby corrected as shown below:

Column 4,
Line 36, after "of the table 18 and" insert -- pays --
Line 61, after "particular order to" delete "vin" and insert therefor -- win --

Column 6,
Line 33, after "play are straight" delete "fonvard" and insert therefor -- forward --

Signed and Sealed this

Twenty-sixth Day of March, 2002

*Attest:*

*Attesting Officer*

JAMES E. ROGAN
*Director of the United States Patent and Trademark Office*